US009240274B2

(12) United States Patent
Lee et al.

(10) Patent No.: US 9,240,274 B2
(45) Date of Patent: Jan. 19, 2016

(54) COMMON MODE FILTER AND METHOD OF MANUFACTURING THE SAME

(71) Applicant: Samsung Electro-Mechanics Co., Ltd., Suwon-si, Gyeonggi-do (KR)

(72) Inventors: Jong Yun Lee, Suwon-si (KR); Sung Kwon Wi, Suwon-si (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 16 days.

(21) Appl. No.: 14/139,226

(22) Filed: Dec. 23, 2013

(65) Prior Publication Data

US 2014/0176280 A1 Jun. 26, 2014

(30) Foreign Application Priority Data

Dec. 26, 2012 (KR) ..... 10-2012-0153493

(51) Int. Cl.

| | |
|---|---|
| ***H01F 5/00*** | (2006.01) |
| ***H01F 27/29*** | (2006.01) |
| ***H01F 41/16*** | (2006.01) |
| ***H01F 17/00*** | (2006.01) |

(52) U.S. Cl.

CPC ..... *H01F 27/29* (2013.01); *H01F 5/00* (2013.01); *H01F 17/0013* (2013.01); *H01F 41/16* (2013.01); *H01F 2017/0093* (2013.01)

(58) Field of Classification Search

CPC ..... H01F 5/00; H01F 27/00–27/32
USPC ..... 336/65, 83, 192, 200, 232
See application file for complete search history.

(56) References Cited

U.S. PATENT DOCUMENTS 7,453,343 B2 * 11/2008 Ito et al. ..... 336/200

FOREIGN PATENT DOCUMENTS

JP 2012-015494 A 1/2012

* cited by examiner

*Primary Examiner* — Tuyen Nguyen
(74) *Attorney, Agent, or Firm* — McDermott Will & Emery LLP

(57) ABSTRACT

Disclosed herein is a common mode filter, including: an external magnetic layer; an insulating layer formed on the external magnetic layer and having coil electrodes therein; a protecting layer formed on the insulating layer; an internal magnetic layer formed inside an opening part formed in one surface of the protecting layer; and external electrode terminals passing through the protecting layer and connected with end portions of the coil electrodes, so that there can be provided a common mode filter having excellent durability, moisture resistance, and heat resistance.

6 Claims, 10 Drawing Sheets

COMMON MODE FILTER AND METHOD OF MANUFACTURING THE SAME

CROSS REFERENCE(S) TO RELATED APPLICATIONS

This application claims the benefit under 35 U.S.C. Section 119 of Korean Patent Application Serial No. 10-2012-0153493, entitled "Common Mode Filter and Method of Manufacturing the Same" filed on Dec. 26, 2012, which is hereby incorporated by reference in its entirety into this application.

BACKGROUND OF THE INVENTION

1. Technical Field

The present invention relates to a common mode filter, and more particularly, to a common mode filter having a protecting layer and a method of manufacturing the same.

2. Description of the Related Art

With the development of technology, electronic devices such as mobile phones, household appliances, PC, PDA, LCD, and the like, are converted from an analog type to a digital type, and are have higher speed due to an increase in data amount. For this reason, USB 2.0, USB 3.0, and a high-definition multimedia interface (HDMI) as high-speed signal transmission interfaces have been widely supplied, and also have been used in many digital devices such as personal computers and digital high-definition televisions.

Theses interfaces employ a differential signal system of transmitting a differential signal (a differential mode signal) by using a pair of signal lines, unlike a single-end signal transmission system generally used for a long time.

Therefore, a common mode filter is generally used to remove common mode noise generated from high-speed differential signal lines and the like. Here, the common mode noise is noise generated from the differential signal lines, and the common mode filter removes this noise that cannot be removed by the existing EMI filter Referring to Japanese Patent Laid-Open Publication No. 2012-015494, the common mode filter of the related art is generally composed of a lower magnetic layer, an upper magnetic layer, and an insulating layer provided therebetween while having coil electrodes therein. In addition, external electrode terminals for connecting the coil electrodes to an external circuit are formed in a post type while passing through the upper magnetic layer.

Generally, the upper magnetic layer is filled with a paste, sol, gel, or the like, while having low density. In this case, the upper magnetic layer is vulnerable to external impact due to weak durability thereof.

In addition, bubbles are contained therein at the time of charging, which may cause permeation of external moisture and the like into the device, resulting in deteriorating characteristics thereof.

RELATED ART DOCUMENT

Patent Document (Patent Document 1) Japanese Patent Laid-Open Publication No. 2012-015494

SUMMARY OF THE INVENTION

An object of the present invention is to provide a common mode filter having high reliability by protecting a magnetic layer with weak durability.

According to an exemplary embodiment of the present invention, there is provided a common mode filter, including: an external magnetic layer; an insulating layer formed on the external magnetic layer and having coil electrodes therein; a protecting layer formed on the insulating layer; an internal magnetic layer formed inside an opening part formed in one surface of the protecting layer; and external electrode terminals passing through the protecting layer and connected with end portions of the coil electrodes.

The protecting layer may be a silicon substrate.

The internal magnetic layer may be bonded to the insulating layer.

The external magnetic layer may be a dry state sheet type.

The external electrode terminals may pass through the internal magnetic layer.

The external magnetic layer and the internal magnetic layer each may have a composition of at least one selected from Fe based, Fe—Si based, Fe—Al based, Fe—Ni based, Fe—Al—Si based, Ni—Zn based, Mn—Zn based, Ni—Zn—Mg based, and Mn—Mg—Zn based ferrites.

According to another exemplary embodiment of the present invention, there is provided a method of manufacturing a common mode filter, the method including: processing an opening part in one surface of a protecting layer; forming an internal magnetic layer inside the opening part; processing holes passing through the protecting layer and then forming external electrode terminals inside the holes; forming an insulating layer having coil electrodes therein on the protecting layer while the external electrode terminals are subjected to growth plate; and forming an external magnetic layer on the insulating layer.

The holes may be formed through wet etching or dry etching.

The internal magnetic layer may be formed by filling a magnetic paste inside the opening part, followed by hardening.

The insulating layer may be formed by repeatedly carrying out an insulating resin coating process and a plating process.

The method may further include, after the forming of the external magnetic layer, performing chip individualizing through a dicing process.

The external magnetic layer may be formed by being bonded on a surface of the insulating layer with an adhesive member interposed therebetween.

DESCRIPTION OF THE PREFERRED EMBODIMENTS

Various advantages and features of the present invention and methods accomplishing thereof will become apparent from the following description of embodiments with reference to the accompanying drawings. However, the present invention may be modified in many different forms and it should not be limited to the exemplary embodiments set forth herein. Rather, these exemplary embodiments may be provided so that this disclosure will be thorough and complete, and will fully convey the scope of the invention to those skilled in the art.

Terms used in the present specification are for explaining the exemplary embodiments rather than limiting the present invention. In the specification, a singular type may also be used as a plural type unless stated specifically. The word "comprise" and variations such as "comprises" or "comprising," will be understood to imply the inclusion of stated constituents, steps, operations and/or elements but not the exclusion of any other constituents, steps, operations and/or elements.

Figure 1:
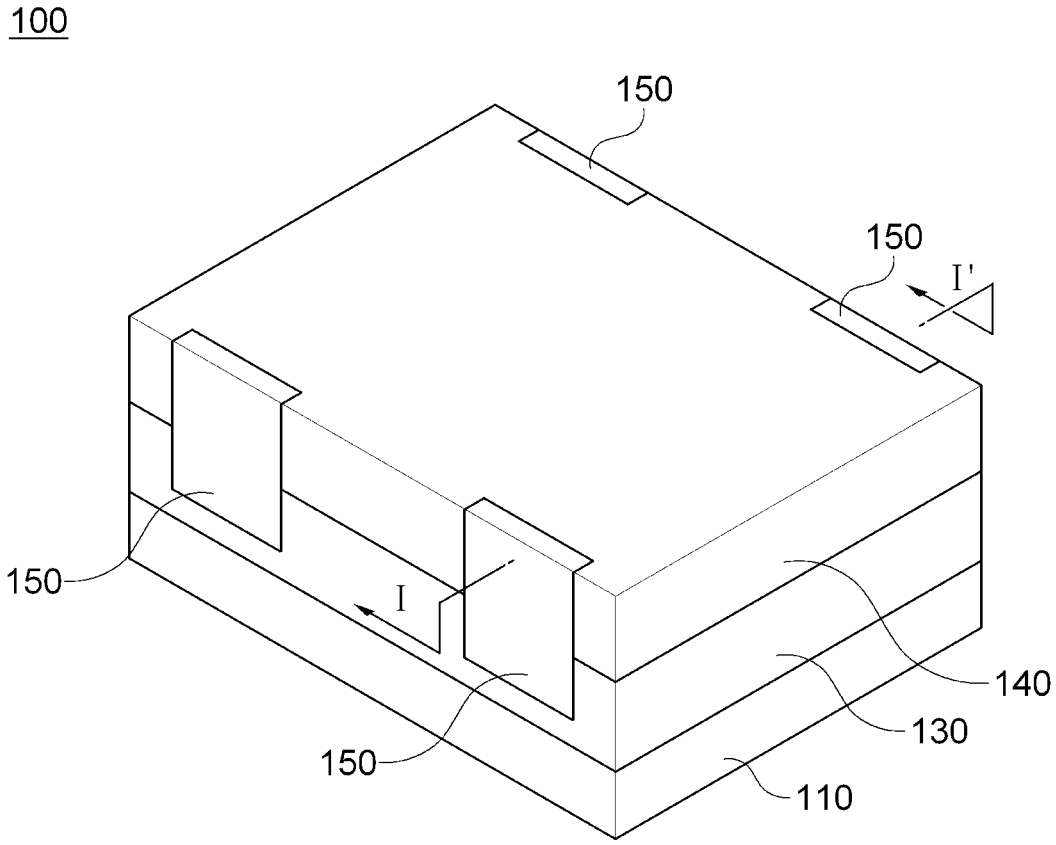
FIG. 1 is a perspective view of a common mode filter according to the present invention.
Figure 2A:
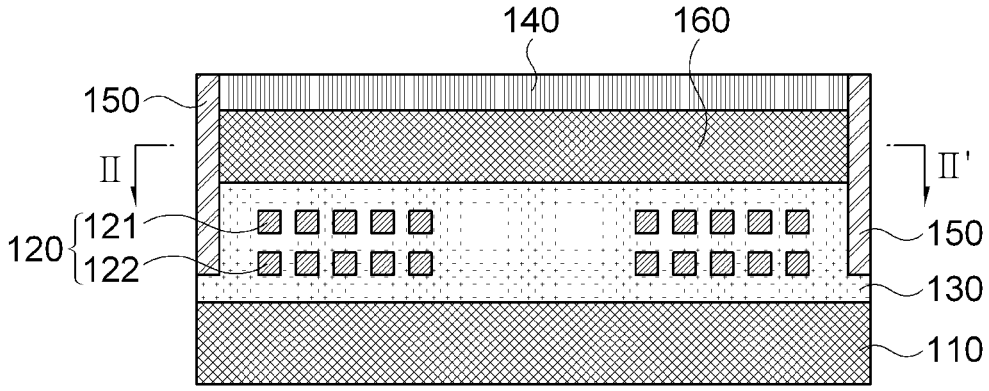
FIG. 2A is a cross-sectional view taken along the line I-I' of FIG. 1.
Figure 2B:
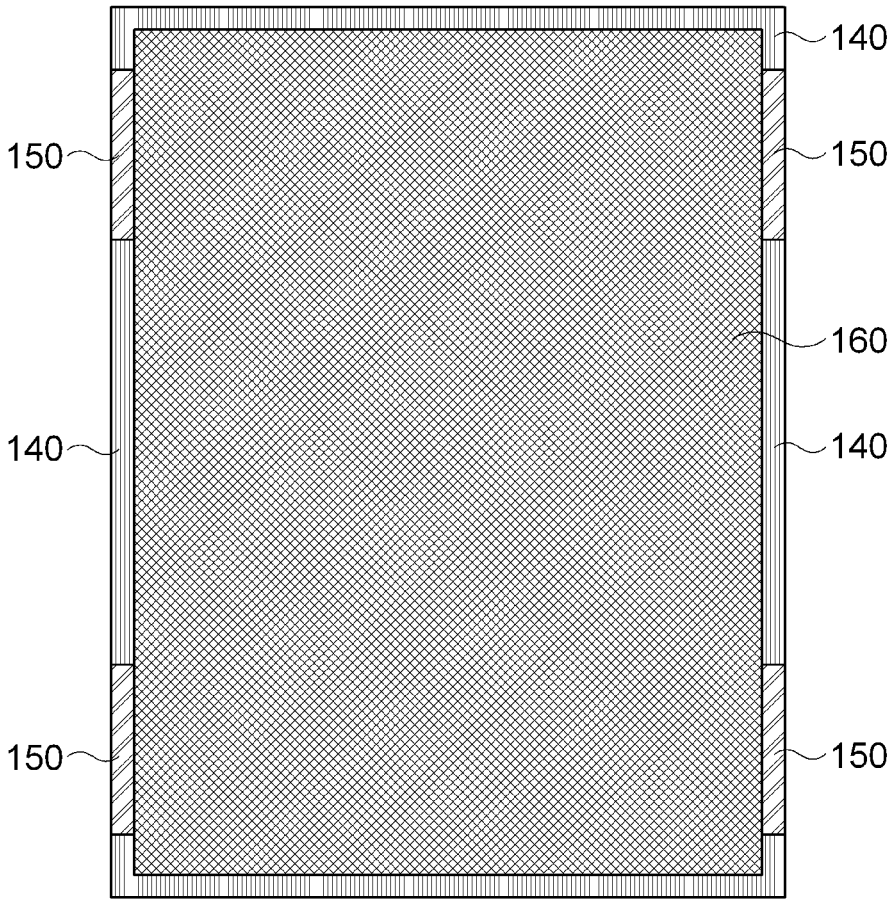
FIG. 2B is a cross-sectional view taken along the line II-II' of FIG. 2A.

FIG. 1 is a perspective view of a common mode filter according to the present invention; FIG. 2A is a cross-sectional view taken along the line I-I' of FIG. 1; and FIG. 2B is a cross-sectional view taken along the line II-II' of FIG. 2A. Additionally, constitutions in the drawings are not necessarily drawn according to the reduced scale. For example, sizes of some constitutions in the drawings may be exaggerated as compared with the other constitutions for better comprehension of the present invention. Meanwhile, the drawings are shown in a general constitution manner for simplifying and clarifying the drawings. In addition, detailed descriptions of the known properties and technology may be omitted in order to avoid unnecessary and unclear descriptions of examples described in the present invention.

Referring to FIGS. 1 and 2, a common mode filter 100 of the present invention may include an external magnetic layer 110, an insulating layer 130 having coil electrodes 120 therein, a protecting layer 140 formed on the insulating layer 130, and external electrode terminals 150 connected with end portions of the coil electrodes 120. In addition, an opening part (141 in FIG. 4) is formed in one surface of the protecting layer 140, and an internal magnetic layer 160 is contained inside the opening part 141.

As for the insulating layer 130 formed on the external magnetic layer 110, a constituent material thereof may be appropriately selected in consideration of insulating property, heat resistance, moisture resistance, and the like. For example, examples of an optimum polymer material constituting the insulating layer 130 may include thermal-hardenable resins such as an epoxy resin, a phenol resin, a urethane resin, a silicon resin, a polyimide resin, and the like, and thermo-plastic resins such as a polycarbonate resin, an acryl resin, a polyacetal resin, a polypropylene resin, and the like.

As for the coil electrodes 120 provided inside the insulating layer 130, a first coil electrode 121 and a second coil electrode 122, which are electromagnetically coupled with each other, may be spaced apart from each other at a predetermined interval in a thickness direction, as shown in FIG. 2A, or may be alternately disposed on the same layer. In addition, the first and second coil electrodes 121 and 122 each may be plural in number, which may be connected to each other by vias. The end portions of the coil electrodes 121 and 122 may be connected with the external electrode terminals 150 through vias or lead wires (not shown).

The external magnetic layer 110 and the internal magnetic layer 160 have high electric resistance and small magnetic loss, and each are composed in a composition of at least one selected from Fe based, Fe—Si based, Fe—Al based, Fe—Ni based, Fe—Al—Si based, Ni—Zn based, Mn—Zn based, Ni—Zn—Mg based, and Mn—Mg—Zn based ferrites, which are easy in impedance design through the change in composition, to thereby be a magnetic route forming space.

Here, the internal magnetic layer 160 is formed by filling a magnetic paste inside the opening part 141, followed by hardening. Here, the magnetic paste is a slurry type magnetic material having low density, and the internal magnetic layer 160 formed thereby has weak durability and bubbles therein, and thus is vulnerable to an external environment. However, in the present invention, since the internal magnetic layer 160 is formed such that it is contained inside the opening part 141 of the protecting layer 140, the internal magnetic layer 160 may be protected from the external environment.

As such, any one side wall of the opening part 141 need not be exposed to an external environment in order that the internal magnetic layer 160 is protected by the protecting layer 140, and thus it is necessary to form length and breadth sizes of the opening part 141 to be smaller than those of the protecting layer 140. In addition, the protecting layer 140 is preferably formed of a material having excellent durability, moisture resistance, and heat resistance, and for example, the protecting layer 140 may be a silicon substrate.

Meanwhile, the external electrode terminals 150 are formed passing through the protecting layer 140, and here, in the case where the opening part 141 has a large area in order to realize high inductance, the external electrode terminals 150 may pass through the internal magnetic layer 160 and the protecting layer 140, unlike FIG. 2B.

Now, a method of manufacturing the common mode filter of the present invention will be described.

FIGS. 3A to 10B are process views sequentially showing a method of manufacturing the common mode filter 100 of the present invention. Here, FIGS. 3A, 4A, . . . , 10A are cross-sectional views and FIGS. 3B, 4B, . . . , 10B are plane views.

Figure 3A:
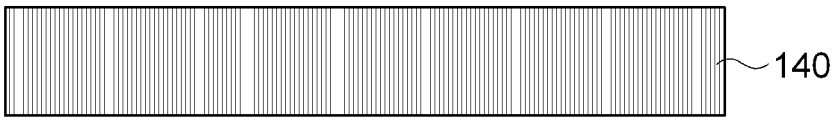
FIGS. 3A to 10B are process views sequentially showing a method of manufacturing the common mode filter of the present invention.
Figure 3B:
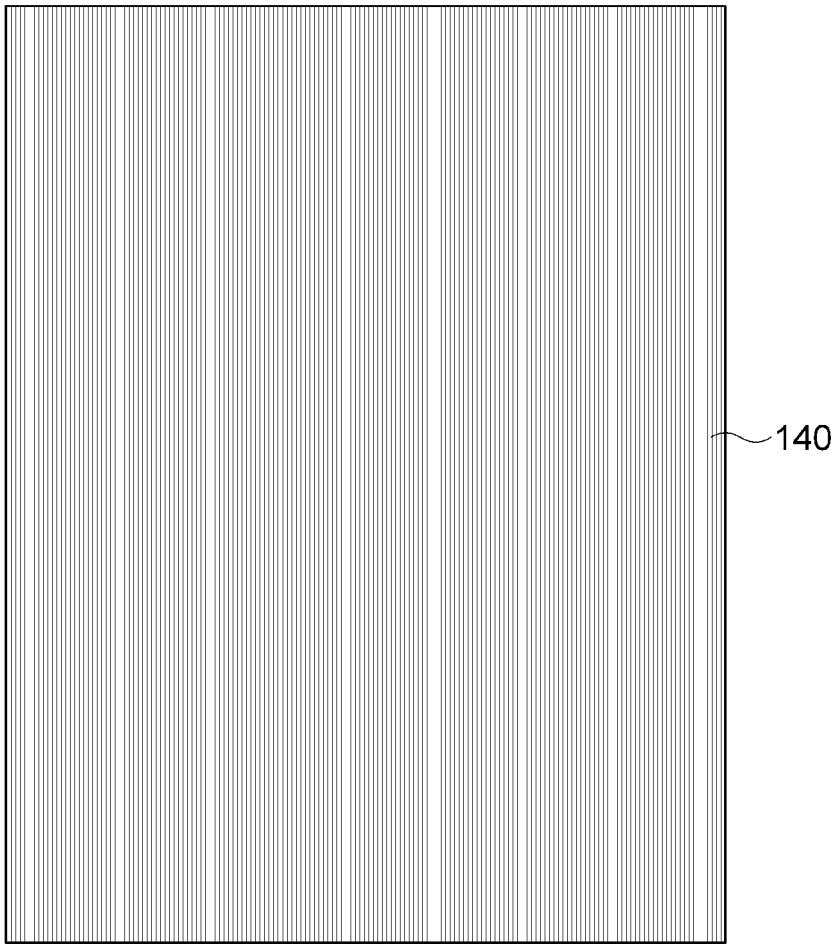
Figure 4A:
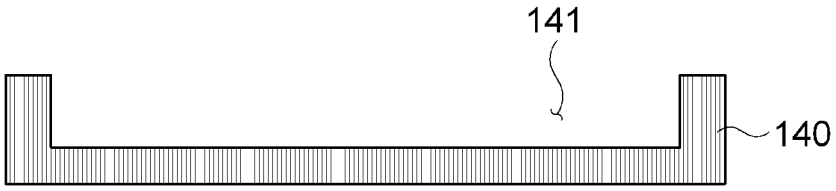
Figure 4B:
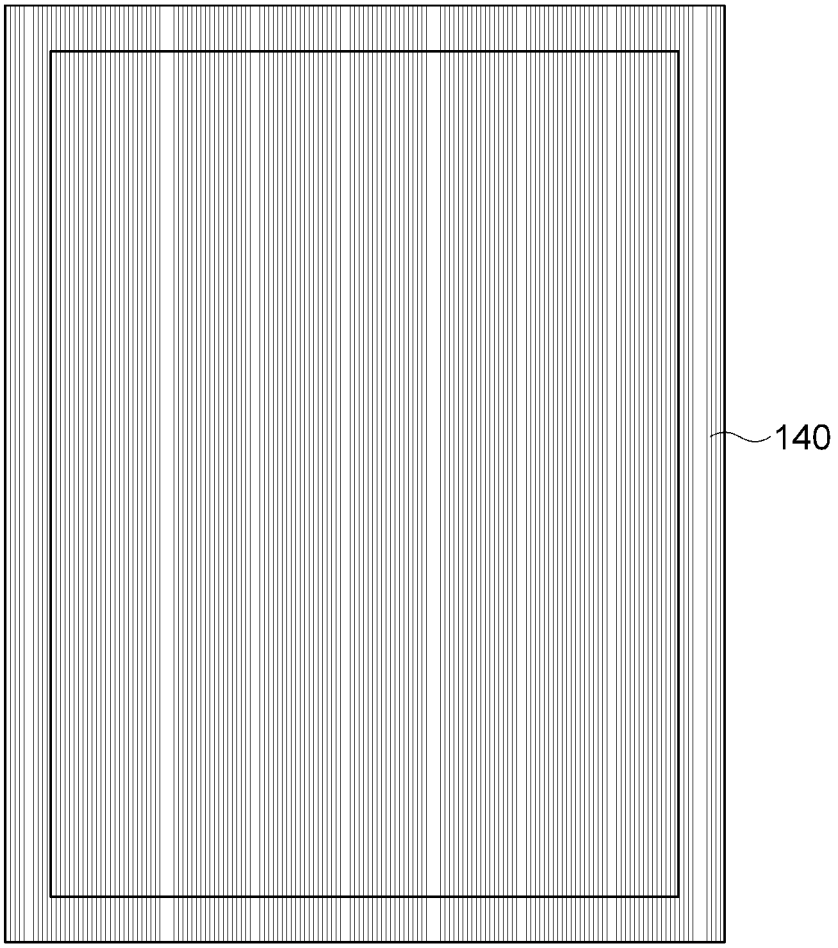

As for the method of manufacturing the common mode filter 100 of the present invention, first, as shown in FIGS. 3A and 3B, a protecting layer 140 is prepared. Then, as shown in FIGS. 4A and 4B, an opening part 141 is processed in one surface of the protecting layer 140.

The protecting layer 140 is a layer for protecting an internal magnetic layer 160 formed inside the opening part 141, and as a constituent material thereof, any one that can have excellent durability may be used without particular limitation. For example, the protecting layer 140 may be prepared by a silicon wafer having a large diameter of 200 mm. The silicon wafer is divided into several sections, and then subsequent processes are carried out for each section, to thereby complete chip devices, and finally, a chip individualizing process may be carried out. The drawings are based on processes carried out for one section.

Length, breadth, and depth sizes of the opening part 141 formed in the protecting layer 140 are determined in consideration of inductance required, but they are allowed to be smaller than those of the protecting layer 140 so that any one side wall of the opening part 141 need not be exposed to an external environment.

The opening part 141 may be formed by attaching a photoresist pattern on an upper surface of the protecting layer 140 and then performing half-etching.

Figure 5A:
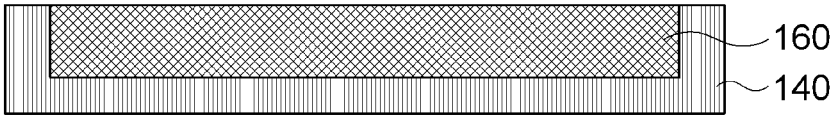
Figure 5B:
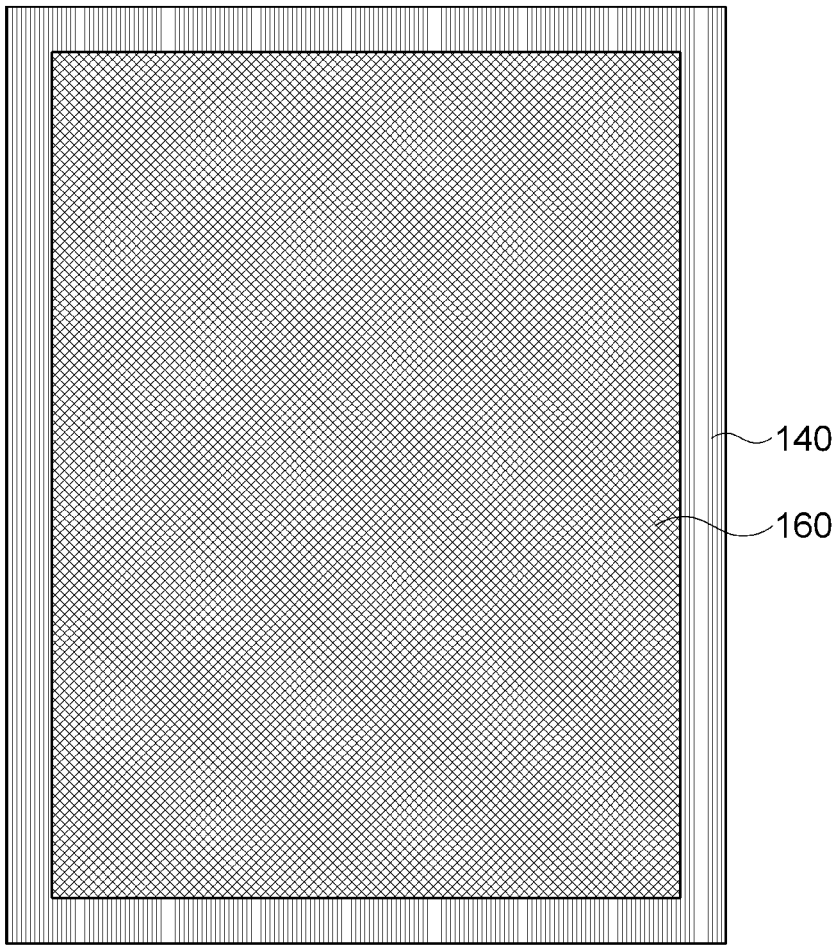

After the opening part 141 having a desired depth is formed by half etching, an internal magnetic layer 160 is formed inside the opening part 141 as shown in FIG. 5.

The internal magnetic layer 160 may be formed by filling a magnetic paste inside the opening part 141 using a general printing process technology such as screen printing or the like, followed by sintering. The magnetic paste may be prepared by adding an organic binder, a plasticizer, and the like to a powder having a composition of at least one selected from Fe based, Fe—Si based, Fe—Al based, Fe—Ni based, Fe—Al—Si based, Ni—Zn based, Mn—Zn based, Ni—Zn—Mg based, and Mn—Mg—Zn based ferrites, and then wet-mixing them using a mixing method such as a ball mill or a basket mill. As necessary, a volatile solvent may blended therewith to control viscosity.

Figure 6A:
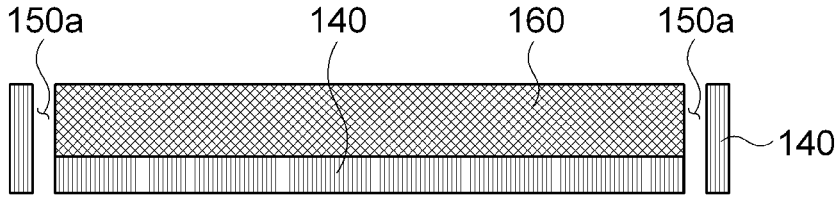
Figure 6B:
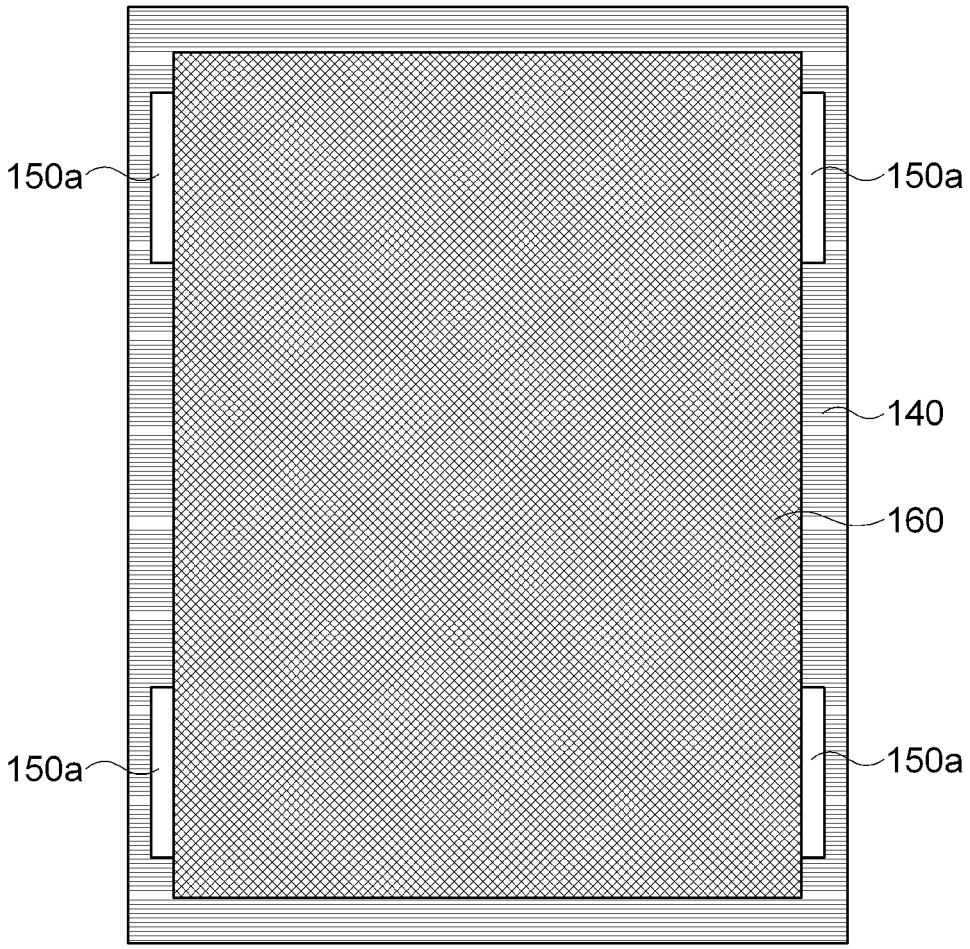

After the internal magnetic layer 160 is formed as such, holes 150*a* passing through the protecting layer 140 is formed at predetermined positions of the protecting layer 140, as shown in FIG. 6.

The holes 150*a* may be formed by a wet etching method of dipping the protecting layer 140 on which the photoresist pattern is attached in an etching liquid or a dry etching method using a reaction by a laser beam or plasma.

The hole 150*a* passes through the protecting layer 140, but the hole 150*a* may pass through an edge of the internal magnetic layer 160 and the protecting layer 140 in the case where the area of the internal magnetic layer 160 is enlarged depending on the required inductance. However, since the internal magnetic layer 160 is not easily etched due to the material nature thereof, it is preferable to process the hole 150*a* to pass through only the protecting layer 140.

Figure 7A:
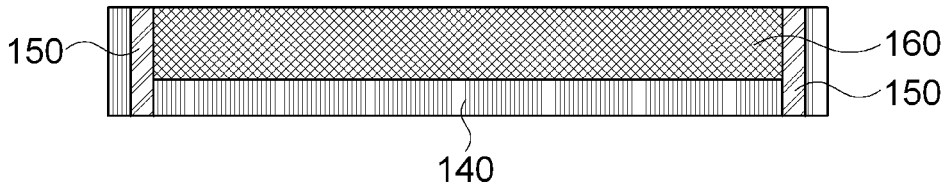
Figure 7B:
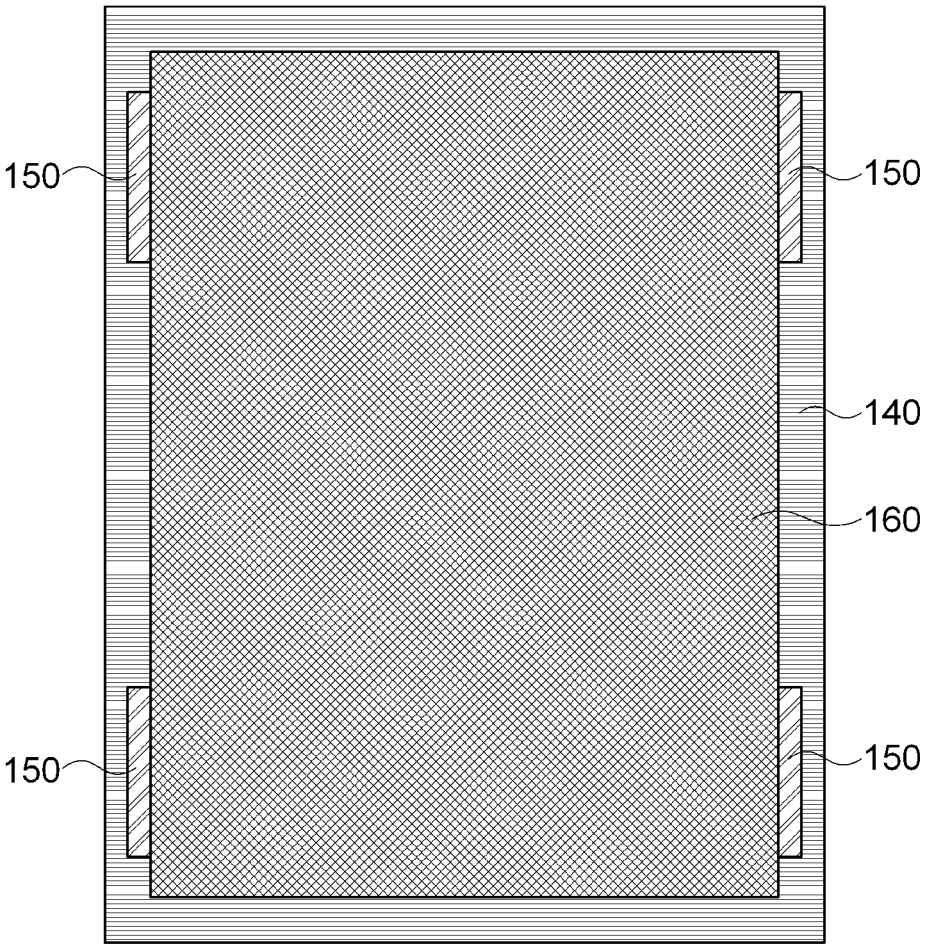

After the holes 150*a* are formed as such, insides of the holes 150*a* are subjected to fill plating to form external electrode terminals 150, as shown in FIGS. 7A and 7B.

The external electrode terminals 150 may be formed of a metal material having excellent conductivity such as Ni, Pd, Ag—Pd, or Cu.

Figure 8A:
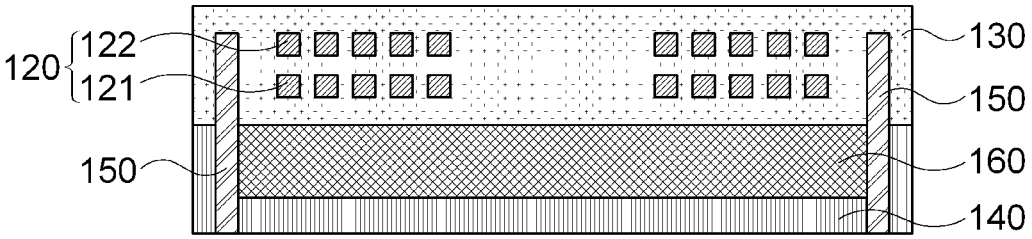
Figure 8B:
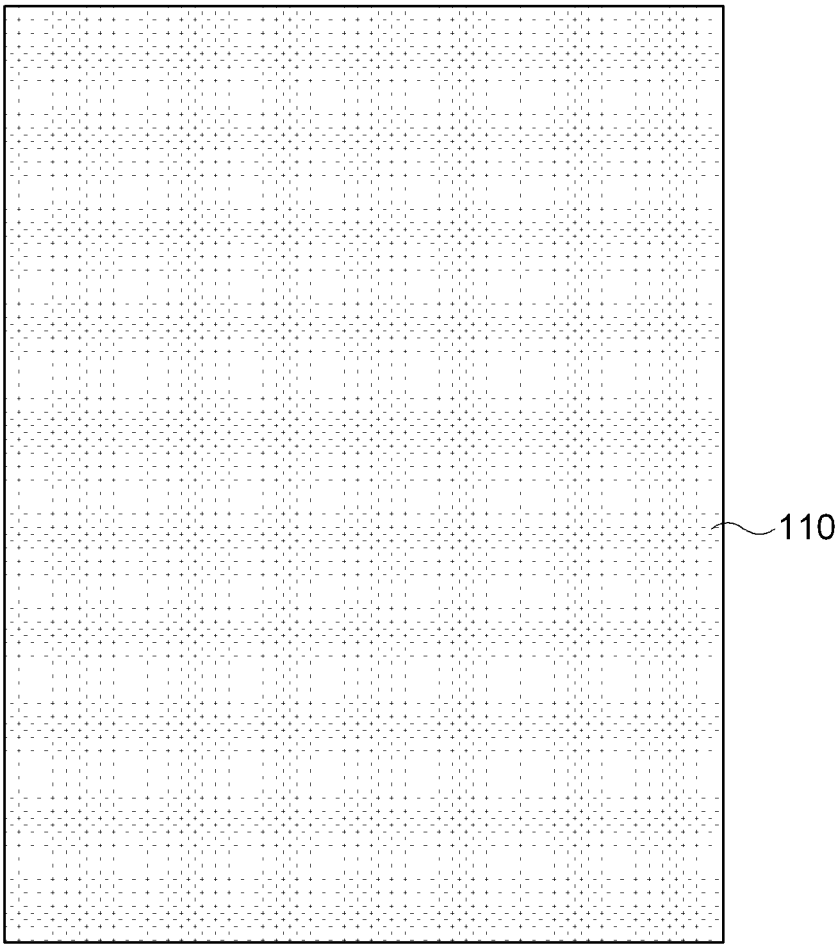

Then, as shown in FIGS. 8A and 8B, an insulating layer 130 having coil electrodes 120 therein is formed on the protecting layer 140. This may be carried out by a buildup process of repeating an insulating resin coating process and a plating process.

The coil electrodes 120 may be plated by using the known technology such as a subtractive method, an additive method, a semi-additive method, or the like. The coil electrodes 120 may be formed such that a first coil electrode 121 and a second coil electrode 122 are spaced apart from each other at a predetermined interval, and here, the external electrode terminals 150 are subjected to growth plate so as to be connected with end portions of the coil electrodes 120 of the respective layers at the time of plating the coil electrodes 120.

Figure 9A:
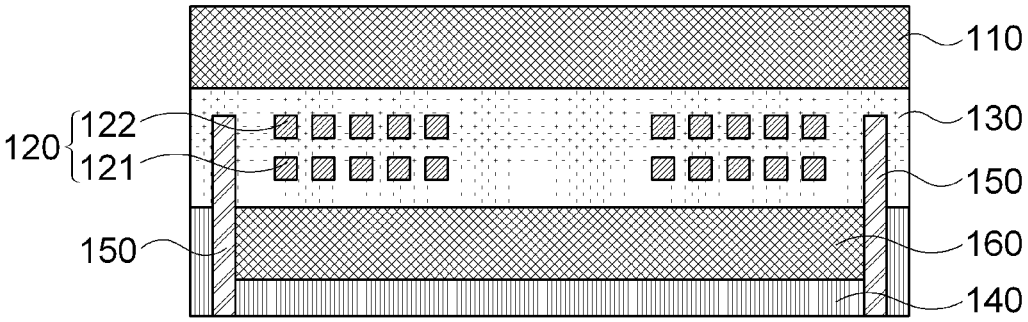
Figure 9B:
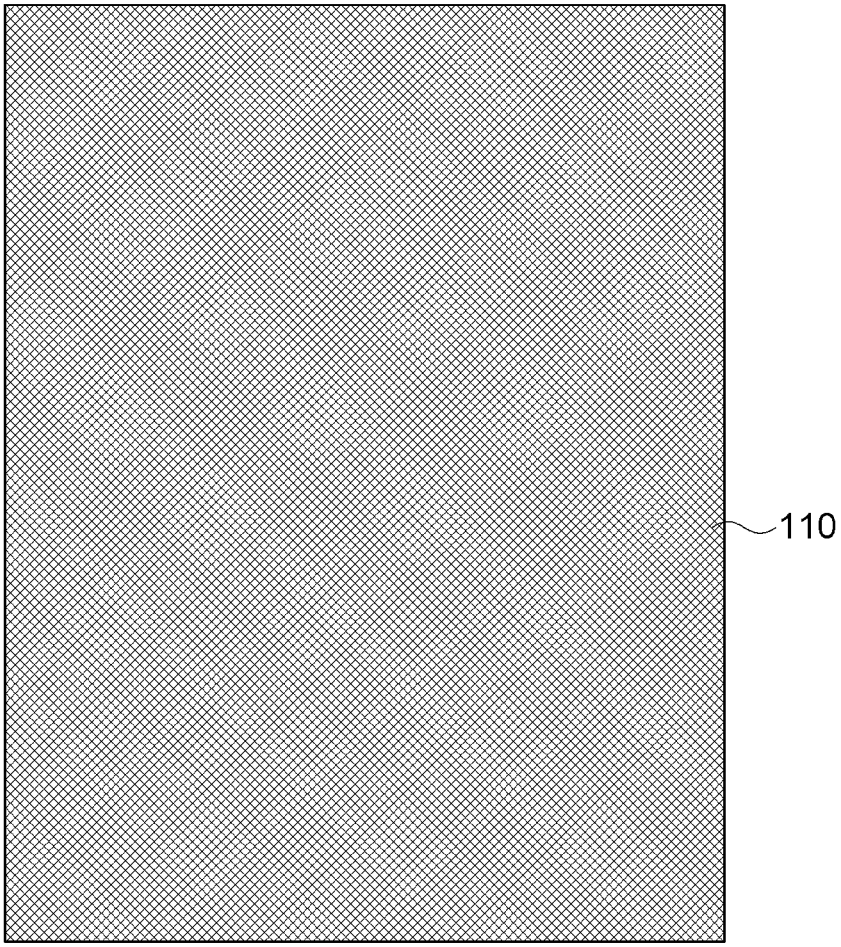

After the insulating layer 130 is completed, an external magnetic layer 110 is formed on the insulating layer 130 as shown in FIGS. 9A and 9B.

The external magnetic layer 110 may be formed as a dry state sheet, which has a composition of at least one selected from Fe based, Fe—Si based, Fe—Al based, Fe—Ni based, Fe—Al—Si based, Ni—Zn based, Mn—Zn based, Ni—Zn—Mg based, and Mn—Mg—Zn based ferrites. This external magnetic layer 110 may be formed by being bonded on a surface of the insulating layer 130 with an adhesive member (not shown) interposed therebetween.

Figure 10A:
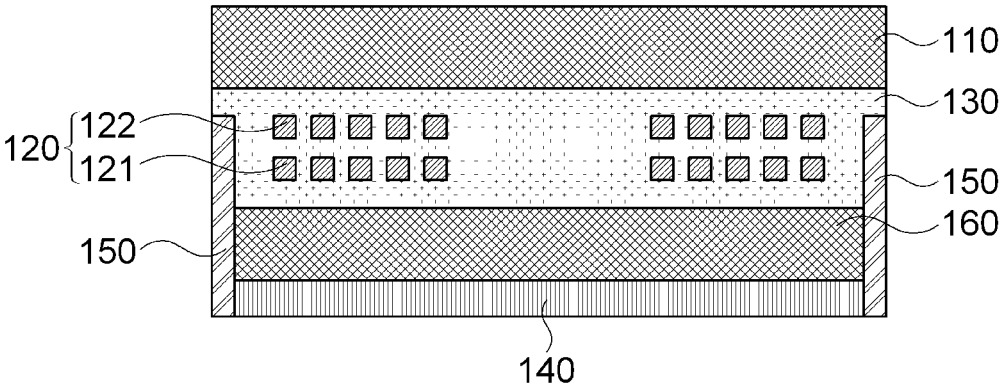
Figure 10B:
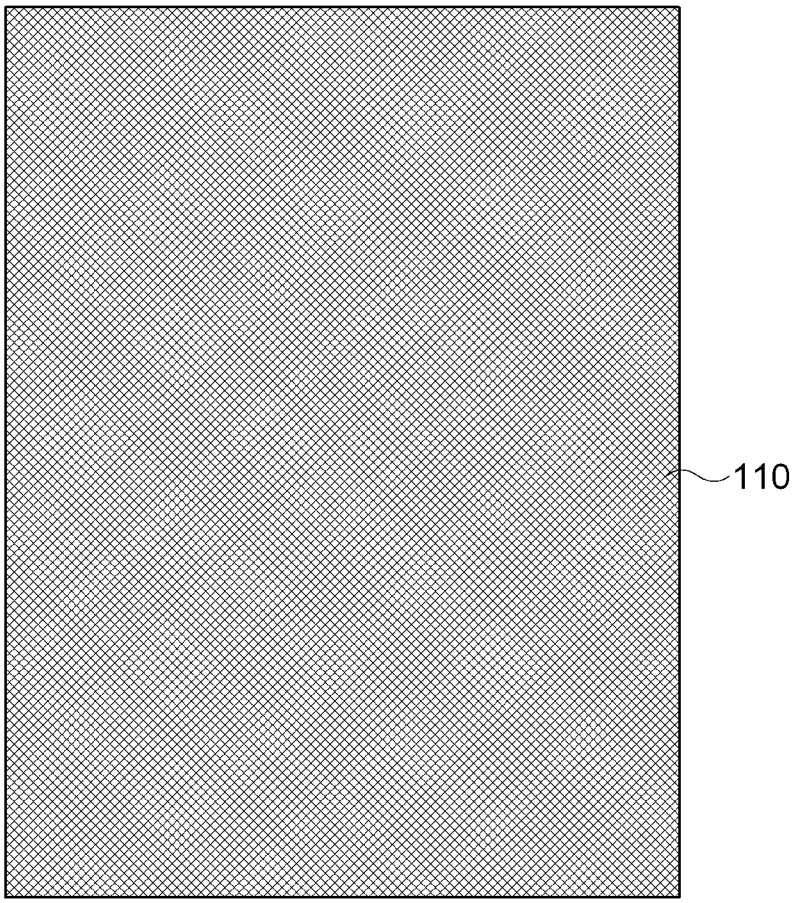

Lastly, as shown in FIGS. 10A and 10B, chip individualizing was carried out according to the predetermined size through a dicing process, to thereby finally complete the common mode filter 100 of the present invention.

The common mode filter 100 manufactured through the foregoing process can protect the internal magnetic layer 160 having weak durability by the protecting layer 140, and thus significantly improve reliability of the product.

In addition, the common mode filter 100 of the present invention is manufactured in a lamination manner while the protecting layer 140 is positioned below, and thus in the case where a silicon wafer having a large diameter as the protecting layer 140, the products can be mass-produced.

As set forth above, according to the present invention, the internal magnetic layer having week durability is formed inside the opening part formed in one surface of the protecting layer, so that a common mode filter having high reliability can be provided.

Further, the common mode filter is manufactured in a lamination manner while the protecting layer is positioned below, and thus in the case where a silicon wafer having a large diameter as the protecting layer, the products can be mass-produced.

The present invention has been described in connection with what is presently considered to be practical exemplary embodiments. Although the exemplary embodiments of the present invention have been described, the present invention may be also used in various other combinations, modifications, and environments. In other words, the present invention may be changed or modified within the range of concept of the invention disclosed in the specification, the range equivalent to the disclosure and/or the range of the technology or knowledge in the field to which the present invention pertains. The exemplary embodiments described above have been provided to explain the best state in carrying out the present invention. Therefore, they may be carried out in other states known to the field to which the present invention pertains in using other inventions such as the present invention and also be modified in various forms required in specific application fields and usages of the invention. Therefore, it is to be understood that the invention is not limited to the disclosed embodiments. It is to be understood that other embodiments are also included within the spirit and scope of the appended claims.

What is claimed is:

1. A common mode filter, comprising:

an external magnetic layer;

an insulating layer formed on the external magnetic layer and having coil electrodes therein;

a protecting layer having an opening part, wherein the opening part is formed on the insulating layer;

an internal magnetic layer formed inside the opening part of the protecting layer such that the internal magnetic layer is not exposed to an exterior; and external electrode terminals connected with end portions of the coil electrodes, wherein the external electrode terminals pass through the protecting layer along with side surfaces of the protecting layer so that side surfaces of the external electrode terminals are exposed.

2. The common mode filter according to claim 1, wherein the protecting layer is a silicon substrate.

3. The common mode filter according to claim 1, wherein the internal magnetic layer is bonded to the insulating layer.

4. The common mode filter according to claim 1, wherein the external magnetic layer is a dry state sheet type.

5. The common mode filter according to claim 1, wherein the external electrode terminals pass through the internal magnetic layer.

6. The common mode filter according to claim 1, wherein the external magnetic layer and the internal magnetic layer each have a composition of at least one selected from Fe based, Fe—Si based, Fe—Al based, Fe—Ni based, Fe—Al—Si based, Ni—Zn based, Mn—Zn based, Ni—Zn—Mg based, and Mn—Mg—Zn based ferrites.

* * * * *